US005094810A

United States Patent [19]

Shira

[11] Patent Number: 5,094,810

[45] Date of Patent: Mar. 10, 1992

[54] METHOD OF MAKING A GOLF CLUB HEAD USING A CERAMIC MOLD

[76] Inventor: Chester S. Shira, 3634 7th Ave., Apt. 4C, San Diego, Calif. 92103

[21] Appl. No.: 604,297

[22] Filed: Oct. 26, 1990

[51] Int. Cl.[5] ..... B22F 7/00

[52] U.S. Cl. ..... 419/6; 419/8; 419/31; 419/38; 419/49

[58] Field of Search ..... 419/6, 8, 31, 49, 38

[56] References Cited

U.S. PATENT DOCUMENTS 4,593,776 6/1986 Salesky et al. ..... 419/49
4,992,236 2/1991 Shira ..... 419/28

*Primary Examiner*—Stephen J. Lechert, Jr.

*Attorney, Agent, or Firm*—John L. Gray

[57] ABSTRACT

A method of making a golf club head and golf club heads produced by said method which involves filling a ceramic mold in the shape of a golf club head with metal powders, the mold optionally containing inserts made from a material selected from the group consisting of metal powders, castings, wrought metal, and green compacts of metal powders and combinations thereof, optionally sintering the material in said mold, compressing the material in said mold and the material contained therein by a process of hot isostatic pressure or a pseudo-isostatic pressure utilizing granular material around said mold to form near 100 percent of the theoretical density of the contents of said mold and thereafter removing said material from said mold.

33 Claims, 1 Drawing Sheet

METHOD OF MAKING A GOLF CLUB HEAD USING A CERAMIC MOLD

BACKGROUND OF THE INVENTION

Applicant's co-pending application Ser. No. 07/465,831, now U.S. Pat. No. 4,992,236 discloses and claims a method of making a golf club head which involves filling a mold with materials selected from the group consisting of metal powders, castings, wrought metal and green compact metal powders and combinations thereof so as to achieve the desired property in particular areas of the club head, compressing the material in a mold to form a green compact material, removing the green compact material from the mold and then heating the green compact material to an elevated temperature to form a sintered product. Thereafter the sintered product may be further heated under pressure to improve its density.

SUMMARY OF THE INVENTION

Applicant has discovered that by using a ceramic mold for compressing the material in the mold by hot isostatic pressing the assembly one can achieve a near 100 percent dense compact after cooling. Hot isostatic pressing involves subjecting the mold or object to gas pressure at elevated temperatures in a suitable vessel. The pressure may be applied directly to the ceramic mold in an isostatic manner or in a pseudo-isostatic manner. Hot pseudo-isostatic pressing involves subjecting the mold or object to gas pressure at elevated temperatures while surrounded by a granular media in a suitable vessel. Included within this definition of hot pseudo-isostatic pressing is the use of granular material which may become liquid at the elevated temperature.

Optionally, prior to the application of hot isostatic pressure or pseudo-isostatic pressure, the mold may be subjected to a temperature sufficient to sinter its contents.

Alternatively, this process may be practiced by subjecting the ceramic mold to hot isostatic pressure to less than 100 percent theoretical density of the contained compact and then removing the compact from the ceramic mold and hot isostatically pressing the compact to near 100 percent theoretical density in the free state or enclosed in a second, lighter ceramic or glass shell. Either hot isostatic pressure may be used or pressure may be applied in a hot pseudo-isostatic manner.

It is therefore an object of this invention to provide an improved method of making a golf club head.

It is a further object of this invention to provide such a golf club head having predetermined desired characteristics determined by the placing of various materials at strategic positions in the golf club head.

These, together with other objects and advantages of the invention will become more readily apparent to those skilled in the art when the following general statements and descriptions are read in light of the appended drawings.

DETAILED DESCRIPTION OF THE INVENTION

In practicing the method constituting the invention, a suitable ceramic mold in the shape of a golf club head is prepared. The mold is filled with the appropriate materials. In some cases these are merely metal powders of different densities and in some cases the mold is created with a combination of metal powders, castings, or wrought metal or green compacts of metal powders. For example, a pattern made from a wax or suitable low melting temperature material is coated with ceramic or glass materials to create a rigid mold. The pattern may contain metallic inserts made of green compacts, castings or wrought metal.

Figure 1:
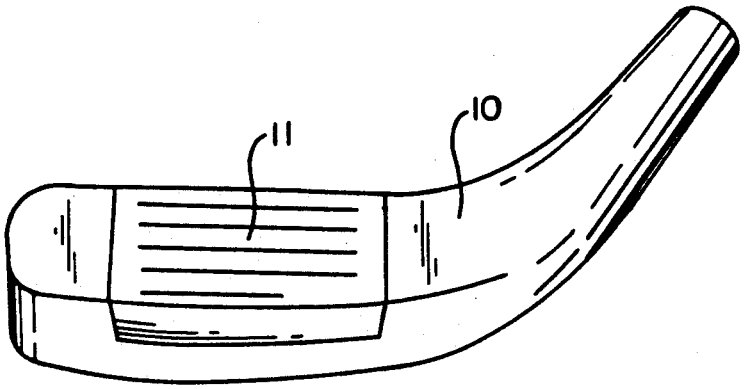
FIG. 1 is a perspective view of a wax pattern containing a metal insert.
Figure 2:
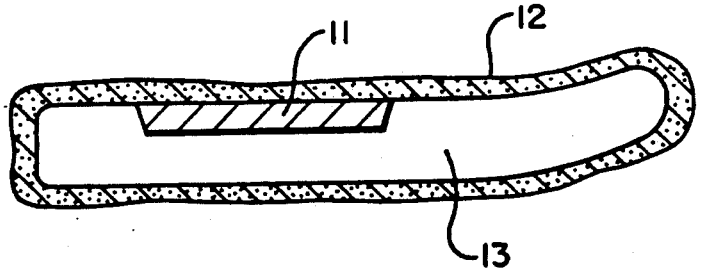
FIG. 2 is a sectional view of the wax pattern after it has been coated with a ceramic to form a mold surrounding the wax that has been heated and removed from the resultant mold.

Referring to FIG. 1, 10 is a wax duplicate or pattern of the golf club head to be manufactured. Inserted in the pattern 10 is a metal insert 11. The pattern 10 is coated with a ceramic or glass material 12 as shown in FIG. 2, which becomes rigid following appropriate heat treatment. The pattern 10 is then removed by heating leaving a mold cavity 13. The metal insert 11 will remain in the cavity 13 bonded to the interior of the ceramic coating 12.

Metal powders and additional inserts may then be placed in the mold cavity 13 to fill all the voids. These additions may be blends of various powders or specific powders, or blends with desired characteristics may be positioned and isolated in different sections of the mold. The mold cavity 13 may then be sealed with a coating (if hot, isostatic pressing will be done in a gaseous environment) or left unsealed if media (pseudo-isostatic) pressing or simple sintering are used. Sintering, if used, may be done in conventional low pressure furnaces, or may be incorporated into the HIP cycle in gaseous and media pressure systems. Compaction and bonding of powders to themselves and to inserts contained may be done in a single hot isostatic pressure cycle or in stages using various levels of pressure and temperature and multiple ceramic, glass or metal coatings as required.

EXAMPLE 1

A wax pattern was coated with several coats of ceramic slurry. The assembly was then heated to remove all wax residue and then baked to cure the ceramic. The mold was then filled with −100 mesh copper-alloy powder in the toe and hosel portion of the club, with an agglomerated mix of 30 micron tungsten carbide and copper alloy powder in the center (clubface) portion of the mold. The mold was agitated to increase the free density of the contained metal powders. The mold and powders were then placed in a retort containing granular graphite, sealed and vacuum pumped and heated to 1650° F. in a hot isostatic pressure vessel. The retort was backfilled with hydrogen and again vacuum pumped several times during the heating cycle. The retort was pressurized at 30,000 psi in nitrogen and held at temperature for 30 minutes.

The resulting clubhead was 100% dense, adequately ductile, had an excellent surface finish, and all grooves and engraving features were sharp and clear.

EXAMPLE 2

A wax pattern was coated with several coats of ceramic slurry and granular materials. The assembly was then heated to remove all wax residue, then baked to cure the ceramic. The mold was then filled with −100 mesh, water-atomized copper-alloy powder in the toe and hosel portion of the club, and with an agglomerated mix of 30 micron tungsten carbide and copper alloy powder in the center (clubface) portion of the mold. The mold was agitated to increase the free density of the contained metal powders. The mold and powders were then heated to 1650° F. in a hydrogen atmosphere and sintered for 30 minutes. The ceramic mold was then removed and a light coating of boron nitride was sprayed on the sintered compact to form a second, but much thinner and more "flexible" ceramic mold. This assembly was then placed in a retort containing granular media, sealed and vacuum pumped, then heated to 1650° F. The retort was then externally pressurized at 30,000 psi in nitrogen and held at temperature for 15 minutes.

The resulting clubhead was 100% dense, quite ductile, had an excellent surface finish, and all grooves and engraving features were sharp and clear.

EXAMPLE 3

A wax pattern was coated with a very thin ceramic coating. After drying the assembly was heated to remove the wax, then further heated to bake the ceramic. The ceramic mold was then filled with −100 mesh copper-alloy powder in the toe and hosel portion of the club, and with an agglomerated mix of 30 micron tungsten carbide and copper-alloy powder in the center (clubface) portion of the mold. The mold was agitated to increase the free density of the contained metal powders. The mold was then sealed and coated with a conductive agent and electroplated with copper to provide a gas-tight enclosure. The mold was placed in a hot isostatic pressure vessel, vacuum pumped and heated to 1650° F. 30,000 psi nitrogen gas pressure was then applied and held for 30 minutes at temperature.

The resulting club head was 100% dense, adequately ductile, had an excellent surface finish, and all grooves and engraving features were sharp and clear.

The above examples are, respectively, examples of the method using hot pseudo-isostatic pressure, sintering the product followed by hot pseudo-isostatic pressure, and finally, hot isostatic pressure.

It will be seen that by utilizing this process, these methods may eliminate at least one step from the process described in co-pending U.S. patent application Ser. No. 07/465,831, now U.S. Pat. No. 4,992,236.

While this invention has been described in its preferred embodiment, it is to be appreciated that variations therefrom may be made without departing from the true scope and spirit of the invention.

What is claimed:

1. A method of making a golf club head which comprises filling a ceramic mold having the shape of a golf club head with metal powders, said mold being empty prior to filling with metal powders except for one or more separate inserts which may be optionally contained therein, said mold optionally containing one or more inserts made from a material selected from the group consisting of castings, wrought metal and green compacts of metal powders and combinations thereof, compressing said mold and said metal powders therein using a process selected from the group consisting of hot isostatic pressure and pseudo-isostatic pressure utilizing granular material surrounding said mold at a pressure sufficient to form nearly 100 percent of the theoretical density of the contents of said mold and thereafter removing said material from said mold.

2. The method of claim 1 wherein said mold is subjected to a temperature sufficient to sinter the contents of said mold prior to compressing said mold and the material contained therein using a process selected from the group consisting of hot isostatic pressure and pseudo-isostatic pressure.

3. The method of claim 1 wherein said pressure utilized is less than sufficient to form a near 100 percent of the theoretical density of the contents of said mold and thereafter removing said material from said mold and thereafter compressing said material removed from said mold by using hot isostatic pressure at a pressure sufficient to form nearly 100 percent of the theoretical density of the material removed from said mold.

4. The method of claim 1 wherein the material in said mold is surrounded with a wear resistant granular material.

5. The method of claim 2 wherein the material in said mold is surrounded with a wear resistant granular material.

6. The method of claim 3 wherein the material in said mold is surrounded with a wear resistant granular material.

7. The method of claim 1 wherein said mold is filled with a heavy alloy in the toe, sole, and heel of the club head and the remainder of the club head is filled with a lighter alloy.

8. The method of claim 1 wherein said mold is filled with a wear resistant alloy in the face of the club head and the remainder of the club head is made of a different alloy.

9. The method of claim 1 wherein said mold is filled with a heavy alloy in the toe, sole, and heel of the club head and the face of the club head is filled with a wear resistant material.

10. The method of claim 1 wherein said mold is filled with sufficient heavy alloy in the toe and sole area of the club head so as to move the center of gravity of the club head to the center of the most frequent impact point of the club head.

11. The method of claim 1 wherein said mold is filled with a heavy alloy in the toe, sole, and heel of the club head and the face of the club head is filled with a material having desirable sonic characteristics.

12. The method of claim 2 wherein said mold is filled with a heavy alloy in the toe, sole, and heel of the club head and the remainder of the club head is filled with a lighter alloy.

13. The method of claim 2 wherein said mold is filled with a wear resistant alloy in the face of the club head and the remainder of the club head is made of a different alloy.

14. The method of claim 2 wherein said mold is filled with a heavy alloy in the toe, sole, and heel of the club head and the face of the club head is filled with a wear resistant material.

15. The method of claim 2 wherein said mold is filled with sufficient heavy alloy in the toe and sole area of the club head so as to move the center of gravity of the club head to the center of the most frequent impact point of the club head.

16. The method of claim 2 wherein said mold is filled with a heavy alloy in the toe, sole, and heel of the club head and the face of the club head is filled with a material having desirable sonic characteristics.

17. The method of claim 3 wherein said mold is filled with a heavy alloy in the toe, sole, and heel of the club head and the remainder of the club head is filled with a lighter alloy.

18. The method of claim 3 wherein said mold is filled with a wear resistant alloy in the face of the club head and the remainder of the club head is made of a different alloy.

19. The method of claim 3 wherein said mold is filled with a heavy alloy in the toe, sole, and heel of the club head and the face of the club head is filled with a wear resistant material.

20. The method of claim 3 wherein said mold is filled with sufficient heavy alloy in the toe and sole area of the club head so as to move the center of gravity of the club head to the center of the most frequent impact point of the club head.

21. The method of claim 3 wherein said mold is filled with a heavy alloy in the toe, sole, and heel of the club head and the face of the club head is filled with a material having desirable sonic characteristics.

22. The method of claim 7 wherein said heavy alloy is a tungsten-rich alloy.

23. The method of claim 9 wherein said heavy alloy is a tungsten-rich alloy.

24. The method of claim 10 wherein said heavy alloy is a tungsten-rich alloy.

25. The method of claim 11 wherein said heavy alloy is a tungsten-rich alloy.

26. The method of claim 12 wherein said heavy alloy is a tungsten-rich alloy

27. The method of claim 14 wherein said heavy alloy is a tungsten-rich alloy.

28. The method of claim 15 wherein said heavy alloy is a tungsten-rich alloy.

29. The method of claim 16 wherein said heavy alloy is a tungsten-rich alloy.

30. The method of claim 17 wherein said heavy alloy is a tungsten-rich alloy.

31. The method of claim 19 wherein said heavy alloy is a tungsten-rich alloy.

32. The method of claim 20 wherein said heavy alloy is a tungsten-rich alloy.

33. The method of claim 21 wherein said heavy alloy is a tungsten-rich alloy.

* * * * *